US005765575A

United States Patent [19]

Denebeim

[11] Patent Number: 5,765,575

[45] Date of Patent: Jun. 16, 1998

[54] HOT-AIR BRUSH WITH NON-CYLINDRICAL HEAD

[76] Inventor: Sabrina R. Denebeim, 260 Avila St., San Francisco, Calif. 94123

[21] Appl. No.: 828,861

[22] Filed: Mar. 31, 1997

Related U.S. Application Data

[63] Continuation-in-part of Ser. No. 764,554, Dec. 12, 1996, which is a continuation-in-part of Ser. No. 644,616, May 1, 1996, Pat. No. 5,711,323, which is a continuation-in-part of Ser. No. 363,256, Dec. 23, 1994, Pat. No. 5,515,874.

[51] Int. Cl.[6] ..... A45D 1/04

[52] U.S. Cl. ..... 132/232; 132/229; 132/227; 132/233; 34/101; 219/222

[58] Field of Search ..... 132/232, 226, 132/227, 233, 229, 266, 269, 271; 34/101, 68, 97; 219/225, 222, 226, 227, 228, 229, 230; 392/383

[56] References Cited

U.S. PATENT DOCUMENTS

| | | | |
|---|---|---|---|
| D. 365,685 | 1/1996 | Denebeim . | |
| D. 365,686 | 1/1996 | Denebeim . | |
| D. 366,152 | 1/1996 | Denebeim . | |
| D. 366,153 | 1/1996 | Stoller . | |
| D. 366,566 | 1/1996 | Denebeim . | |
| 3,922,521 | 11/1975 | Viegut et al. | 219/222 |
| 3,955,064 | 5/1976 | Demetrio et al. | 132/232 |
| 4,023,578 | 5/1977 | Buhler . | |
| 4,192,325 | 3/1980 | Liedtke . | |
| 4,250,902 | 2/1981 | Ihara . | |
| 4,328,818 | 5/1982 | Glucksman . | |
| 4,365,426 | 12/1982 | Suzuki et al. | 132/229 |
| 4,564,032 | 1/1986 | Araki . | |
| 4,625,738 | 12/1986 | Skovdal et al. | 132/229 |
| 5,212,366 | 5/1993 | McDougall | 219/222 |
| 5,365,037 | 11/1994 | Chan . | |
| 5,479,951 | 1/1996 | Denebeim . | |
| 5,584,307 | 12/1996 | Bauer et al. | 132/227 |

*Primary Examiner*—Gene Mancene
*Assistant Examiner*—Pedro Philogene
*Attorney, Agent, or Firm*—Majestic, Parsons, Siebert & Hsue

[57] ABSTRACT

A hot-air brush using a non-cylindrical brush head is provided to enable a user to obtain a helical curl having a continuum of varying diameters within each lock of curled hair. This varying-diameter helix provides a new and distinct look for the curled hair. The non-cylindrical head may be substantially spherical or substantially conical.

22 Claims, 4 Drawing Sheets

HOT-AIR BRUSH WITH NON-CYLINDRICAL HEAD

This is a continuation-in-part of U.S. patent application Ser. No. 08/764,554 filed Dec. 12, 1996; which is a continuation-in-part of U.S. patent application Ser. No. 08/644,616, filed May 1, 1996; now Pat. No. 5,711,323 which is a continuation-in-part of U.S. patent application Ser. No. 08/363,256, filed Dec. 23, 1994, now issued into U.S. Pat. No. 5,515,874 on May 14, 1996; herein referred to as the "Parent Applications."

BACKGROUND OF THE INVENTION

This invention relates generally to personal grooming devices, and more particularly to devices useful for hair-styling and for curling locks of hair.

Many persons with straight hair wish to temporarily alter their hairstyle through techniques such as blowdrying with a hot-air brush. It has been customary in grooming hair with a hot-air brush to roll a tress or a plurality of strands of hair on a cylindrical head of the hot-air brush.

However, the curl imparted by a typical cylindrical brush-head of the hot-air brush is limited to the constraints of a constant-diameter brushhead. The resultant lock of hair which has been curled using this technique forms a helical shape having a relatively constant diameter. Small diameter cylindrical heads produce small helixes and large diameter cylindrical heads produce large helixes.

It is therefore an object of the present invention to overcome the disadvantages associated with conventional hot-air brushes, and to provide a novel hairstyling technique for styling hair into shapes which cannot be achieved using conventional hot-air brushes.

SUMMARY OF THE INVENTION

In the present invention, a hot-air brush is provided with a hot-air blower in a handle and a non-cylindrical shaped head to enable a user to obtain a helical curl having a continuum of varying diameters within each lock of curled hair. This varying-diameter helix provides a new and distinct look for the curled hair. The hot-air blower allows the hair to be quickly set into the distinct new look.

According to an aspect of the present invention, a hair-styling device is provided which includes a hot-air blower apparatus, a non-cylindrical brush head, and a plurality of projections, such as bristles, radiating from the brush head. The non-cylindrical brush head preferably has a variety of diameters along its length.

In a preferred embodiment, the non-cylindrical brush head is substantially spherically shaped. In another preferred embodiment, the non-cylindrical brush head is substantially conical shaped.

In a preferred embodiment, vents or holes are provided in a spherical brush head to allow for quicker, easier drying of hair. Hot air from the hot-air blower can pass through the spherical head to dry the user's hair.

The hot-air brush of the present invention is able to curl the hair into helical-shaped curls of varying diameters instead of cylindrical-shaped curls obtained from conventional hot-air brushes. The present invention makes it easier for the user to create curls in the back of the head. It also allows the user to do fuller, more convenient curling that flips upwards, and creates rounder, uniquely-shaped curls. The curls obtained using the ball-shaped brush of the present invention are fuller at the root of the hair because of the rounded shape of the curling head.

Additional objects, features and advantages of the various aspects of the present invention will become apparent from the following description of the preferred embodiment in conjunction with the accompanying drawings.

DETAILED DESCRIPTION OF THE PREFERRED EMBODIMENT

Figure 1A:
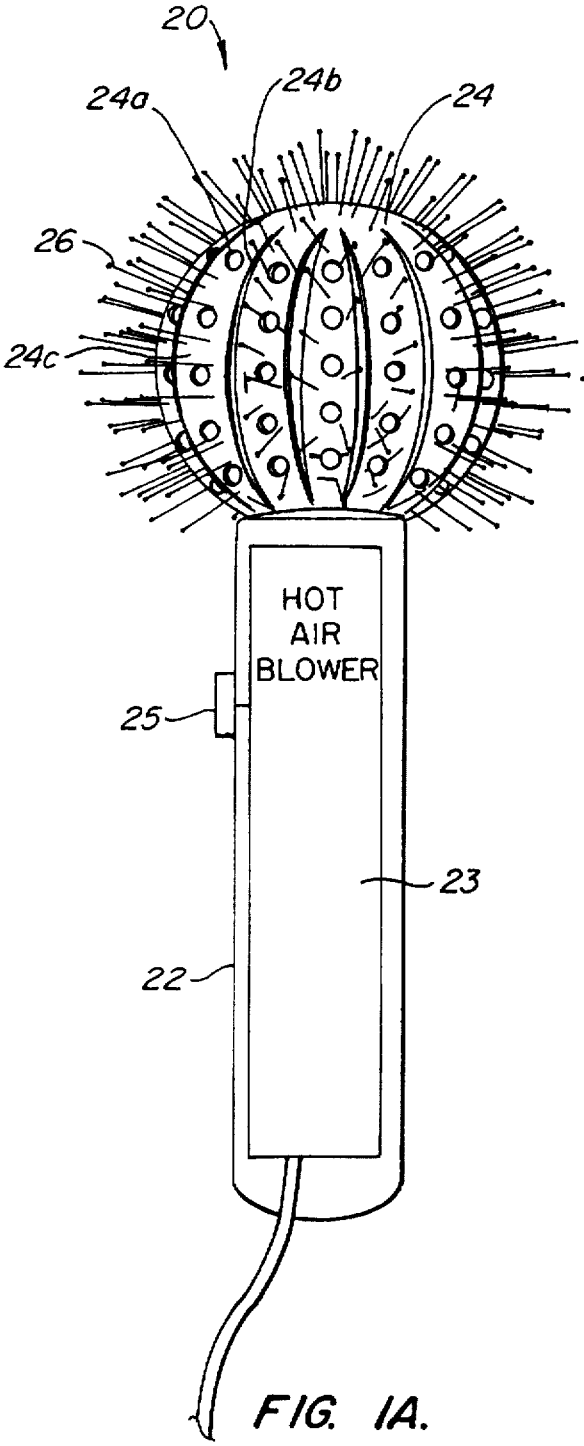
FIGS. 1A–1C illustrate an embodiment of a hot-air brush with a spherical brush head of the present invention.
Figure 1B:
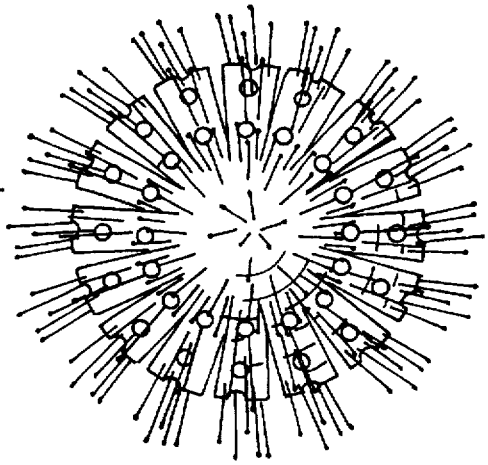
Figure 1C:
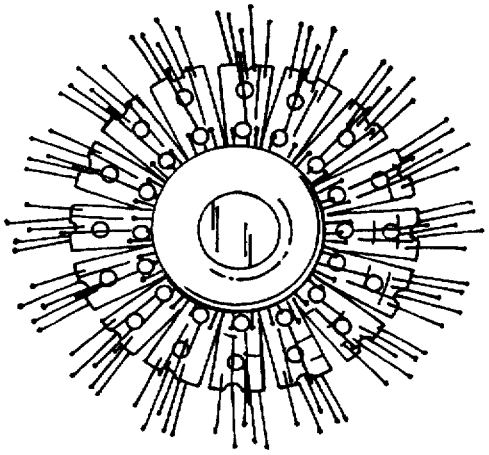

FIGS. 1A-1C illustrate an embodiment of the spherical hot-air brush 20 of the present invention. FIG. 1A illustrates a frontal view of the hot-air brush 20. FIG. 1B illustrates a top view of the hot-air brush 20, and FIG. 1C illustrates the bottom view of the hot-air brush 20. As shown in FIG. 1A, hot-air brush 20 includes a handle 22, a spherical brush head 24, and projections 26. The handle 22 includes a hot-air blower 23 that flows hot air to the inside of the spherical brush head 24. A switch 25 on the handle 22 controls the operation of the hot-air blower 23. The hot-air blower can be of a conventional type used with hot-air brushes. The hot-air blower apparatus can be inside a handle as shown or in any other shaped design. The hot-air blower apparatus could be a conventionally shaped hair dryer, for example.

In the embodiment shown in FIG. 1A, the spherical brush head 24 is hollow and has defined thereon a number of holes. These holes include spherical holes **24*a* and slivers 24*b*. These circular holes 24*a* and slivers 24*b* allow the air from the hot-air brush to pass through the spherical brush head 24, thereby aiding in the drying and shaping of the hair. The spherical hair brush 24 in the preferred embodiment is hollow. In one embodiment, the brush head is made of metal with the projections made of heat-resistant plastic. The projections 26 can be bristles as shown in FIG. 1A** or thicker projections to aid in heat resistance.

Because different portions of hair are wrapped around a single spherical head at different locations on the head, the diameter of the resulting curls will vary, depending upon the diameter portion of the spherical head onto which each part of hair is wound. The curls which result using the spherical head retain a helical shape with a continuum of differing diameters. For example, the resulting curls start out having a small diameter, then progress to a larger diameter, and again reduce to a smaller diameter. Thus, the use of a spherical brush head provides the unexpected advantage of producing a helical curl with a continuum of differing diameters.

Conventional hot-air brushes are unable to provide the advantages and/or hair styling shapes obtained by using the hot-air brush with a spherical brush head of the present invention. Additionally, the unique shape of the spherical brush head of the present invention in combination with hair-gripping bristles allows the hairbrush of the present invention to be used in a manner which can not be duplicated using conventional, cylindrical hair brushes.

For example, a user using the hot-air brush 20 shown in FIG. 1 of the drawings is able to wind a lock of hair around the spherical brush head of the hot-air brush, and is then able to continue to wind or rotate the hot-air brush while simultaneously moving the position of the brush head to another portion of the scalp to thereby cause an additional section of hair to be wound upon the hairbrush while the previous section of hair is shaped and released.

Starting from the top portion of the brush head, there is a continuum of circles of bristles which gradually increase in diameter until the middle portion of the brush head is reached. As the hairbrush is rotated and moved laterally, this continuum of increasing circles of bristles acts as a spiral or corkscrew which initially grabs the hair at the top portion of the brush head, winds the hair around the middle portion of the brush head, and eventually releases the hair at the bottom portion of the brush head.

Due to the unique shape of the spherical brush head of the present invention, the diameter of the circle of bristles at the top portion of the brush head is smaller than the diameter of the circle of bristles at the middle portion of the brush head. As the hairbrush is rotated and simultaneously moved across a portion of the scalp such as, for example, the bang area where the hairline meets the forehead, the smaller circle of hair-gripping bristles initially grabs the hair and wraps the hair around the body of the brush head. As the hairbrush is continually rotated and moved laterally along the hairline, the spiraling effect of the bristles causes each portion of hair to be wrapped around the middle portion of the spherical brush head and ultimately released at the bottom portion of the brush head. Simultaneously, new locks of hair are continually being grabbed by the bristles at the top portion of the brush head and spiraled inward towards the middle section. Using this technique, it is possible to style hair both quickly and conveniently and to obtain fuller, richer curls as compared to hair styling techniques using conventional, cylindrical hot-air brushes. Moreover, conventional hot-air brushes are not able to provide the hair spiraling function that is achievable using the spherical hot-air brushes of the present invention in combination with hair-gripping bristles.

Additionally, the spherical shape of the brush head of the present invention permits a user to continuously rotate the brush head even after an entire lock of hair has been wound around the brush head. As the spherical hair styling device is continually rotated, the lock of hair which is wrapped around the device is allowed to slip and, because of its spherical shape, the top and bottom portions of the spherical brush head taper away from the middle section where the brush head meets the scalp. This tapering effect allows hair which has been wrapped around the brush or curling iron head to easily slip away and/or release itself from the head of the hair styling device. With conventional, cylindrical hot-air brushes, however, once the hair has been completely wound upon the shaft or head of the hot-air brush, the hot-air brush is not able to be rotated further without pulling the hair.

Figure 2A:
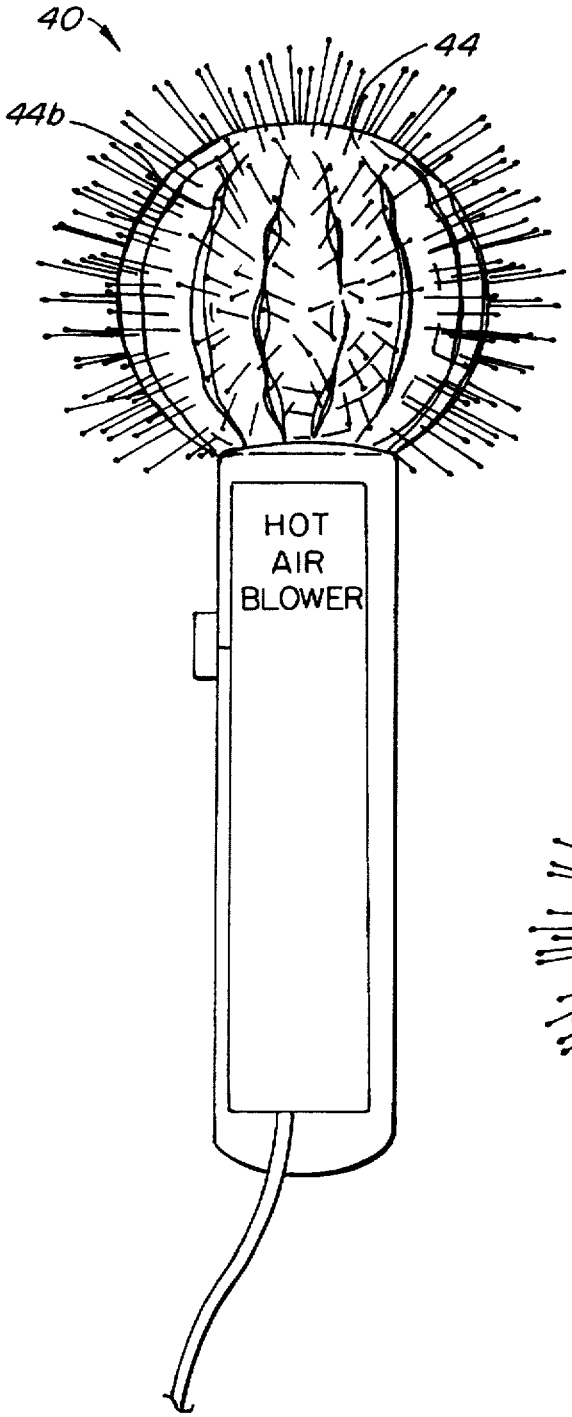
FIGS. 2A–2C illustrate an alternate embodiment of the hot-air brush with a spherical brush head of the present invention.
Figure 2B:
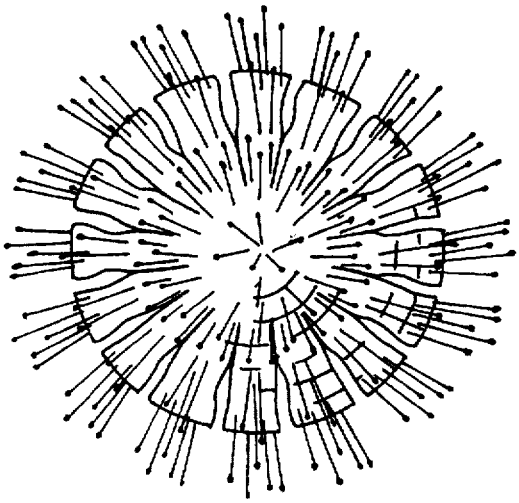
Figure 2C:
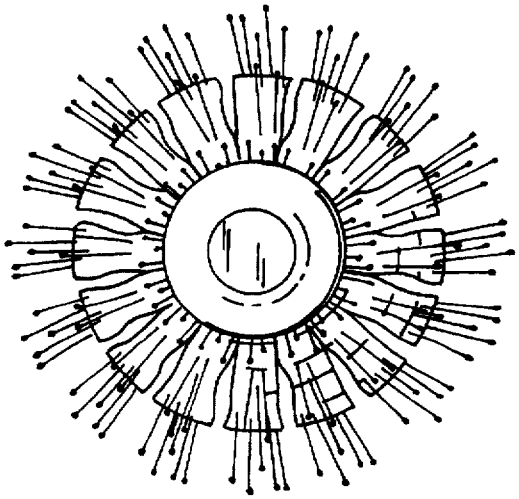

FIGS. 2A–2C illustrate an alternate embodiment of the spherical hot-air brush 40 of the present invention. FIG. 2A illustrates a frontal view of the hot-air brush 40. FIG. 2B illustrates a top view of the hot-air brush 40, and FIG. 2C illustrates a bottom view of the hot-air brush 40. The spherical head 44 includes wavy vents **44*b*, but does not include any holes formed in the strips defined by the vents 44*b***.

Figure 3:
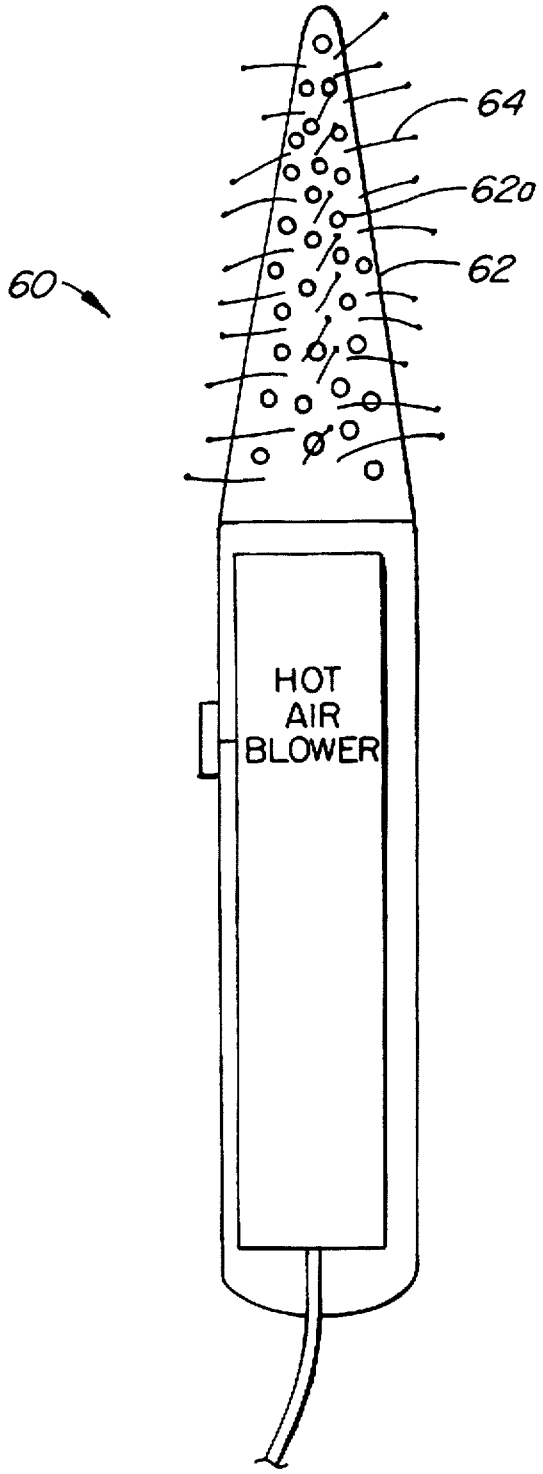
FIG. 3 illustrates a hot-air brush with a conical-shaped brush head.

FIG. 3 illustrates a hot-air brush 60 with a conical brush head 62. The conical brush head produces curls having a varying helical diameter starting with the greatest diameter near the base, then expanding to a smaller diameter near the tip of the hair. The conical head 62 is shown with holes **62*a* and bristles 64**. The use of holes, rather than slits, may be advantageous for use with the hot-air blower.

The embodiments of FIGS. 1–3 include holes defined into the head to allow the hair to dry more quickly. Additionally, air from the blow drier can circulate within the brush head, warming up the brush from the inside, and thus aid in the styling of the hair. Furthermore, the use of vents or holes makes the brush-head lightweight and thus easier to use. A light-weight brush-head in the head can be moved more quickly through the hair.

In order to facilitate the use of these holes in the spherical hair brush, in a preferred embodiment the spherical hair brush has a hollow spherical brush head. The hollow head is lightweight and thus easier to use. The spherical hair brush of FIGS. 1–3 allows for the improved curls to be made quicker and more efficiently.

For each of the embodiments of FIG. 1 through FIG. 3, the holes are preferably formed on all sides of the spherical head so that hot air from the hot-air blower can circulate within the brush-head and come out more than one vent or hole.

The use of the vents and holes for these embodiments has a special advantage with a spherical-shaped head, because it allows for the hair to be dried quickly into the full-body shape. Because the spherical hair brush can style different hair locations without being released from the hair, it is desirable to dry the hair relatively quickly as the brush is moved along in the hair. The holes or vents aid in this drying process.

In another embodiment, the brushhead can be detachable from the handle. This can allow the switching of brush heads of different styles and sizes. The brush head can use clips to attach to the handle.

Figure 4:
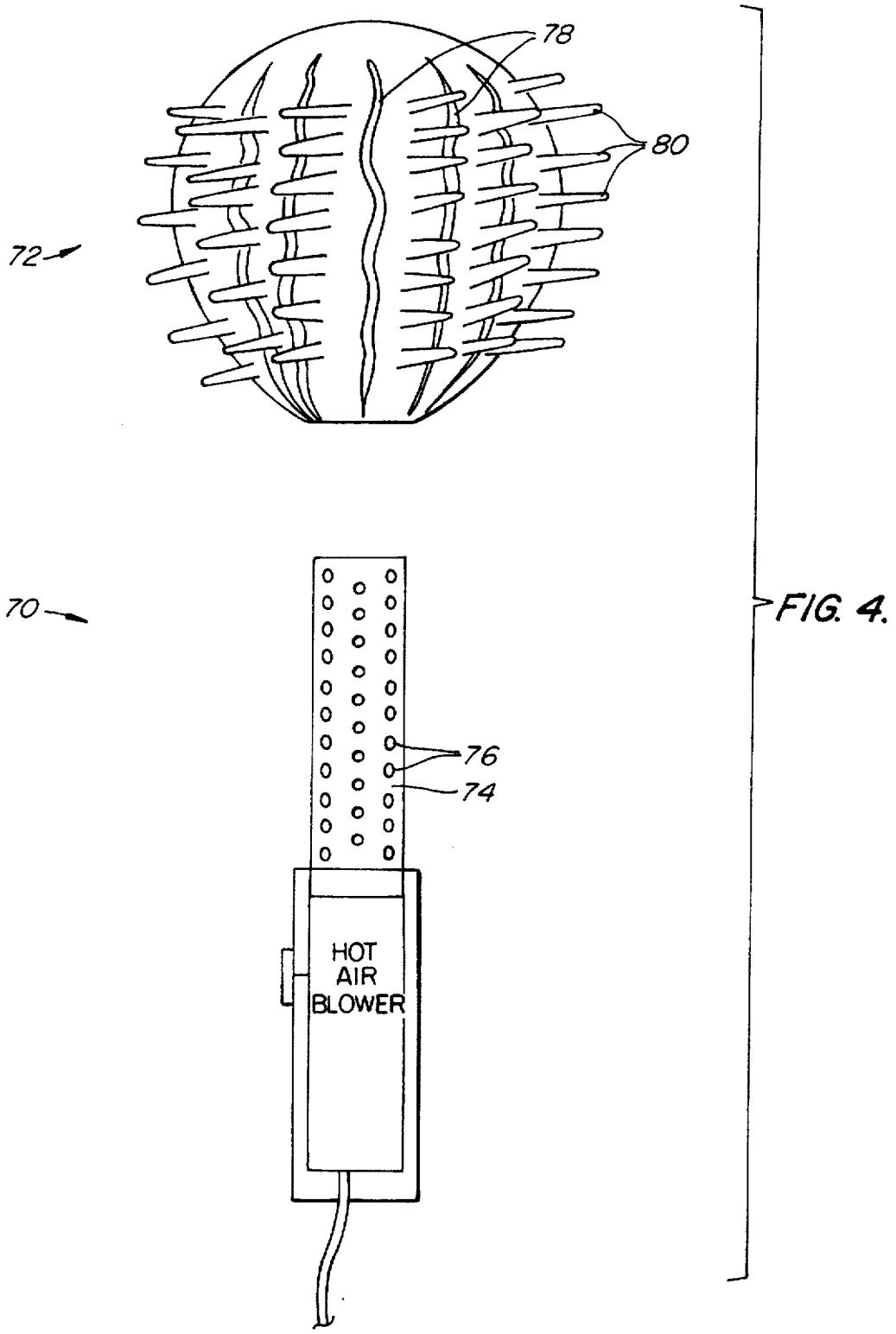
FIG. 4 is an exploded diagram illustrating a hot-air brush of the present invention.

FIG. 4 is an exploded diagram illustrating a hot-air brush 70. This hot-air brush 70 has a cylindrical portion 74 with holes 76. The hot air from the hot-air blower 78 is directed into the hollow cylindrical portion 74 and out the holes 76. The brush head 72 is mounted around the cylindrical portion 74. The brush head can be detachable or permanently attached. The cylindrical portion 74 can help distribute the hot air within the hot-air brush head 72. The hot air passes out of the brush head 72 through holes or slits 78. Bristles 80 are positioned on the brush head 72.

Although several preferred embodiments of this invention have been described in detail herein with reference to the accompanying drawings, it is to be understood that the invention is not limited to these precise embodiments, and that various changes and modifications may be effected therein by one skilled in the art without departing from the scope or spirit of the invention as defined in the appended claims.

What is claimed is:

1. A hot-air brush comprising:

a brush head having a substantially spherical shape, wherein the brush head defines holes which allow the passage of air through the brush head;

a plurality of projections radiating out from said brush head; and a handle attached to the brush head, the handle containing a hot-air blower, the hot-air blower arranged to supply hot air into the brush head.

2. The hot-air brush of claim 1 wherein the projections are bristles.

3. The hot-air brush of claim 1 wherein the holes comprise vents.

4. The hot-air brush of claim 1 wherein the brush head is made of a metal material.

5. The hot-air brush of claim 1 wherein the projections are made of heat-resistant plastic.

6. The hot-air brush of claim 1 wherein the brush head is hollow.

7. The hot-air brush of claim 1 wherein the brush head is detachable from the handle.

8. A hot-air brush comprising:

a brush head having a substantially conical shape, wherein the brush head defines holes which allow the passage of air through the brush head;

a plurality of projections radiating out from said brush head; and a handle attached to the brush head, the handle containing a hot-air blower, the hot-air blower arranged to supply hot air into the brush head.

9. The hot-air brush of claim 8 wherein the projections are bristles.

10. The hot-air brush of claim 8 wherein the holes comprise vents.

11. The hot-air brush of claim 8 wherein the brush head is made of a metal material.

12. The hot-air brush of claim 8 wherein the projections are made of heat-resistant plastic.

13. The hot-air brush of claim 8 wherein the brush head is hollow.

14. The hot-air brush of claim 8 wherein the brush head is detachable from the handle.

15. A hair-styling apparatus comprising:

a brush head having a non-cylindrical shape, wherein the brush head defines holes which allow the passage of air through the brush head;

a plurality of projections radiating out from said brush head; and a hot-air blower apparatus attached to the brush head, the hot-air blower apparatus arranged to supply hot air into the brush head.

16. The hair-styling apparatus of claim 15 wherein the brush head's diameter varies along the length of the brush head.

17. The hair-styling apparatus of claim 15 wherein the brush head has a substantially spherical shape.

18. The hair-styling apparatus of claim 15 wherein the brush head has a substantially conical shape.

19. The hair-styling apparatus of claim 15, wherein the hot-air blower apparatus is a hot-air blower attached to the brush head.

20. The hair-styling apparatus of claim 15 wherein the projections are bristles.

21. The hot-air brush of claim 15 wherein the brush head is detachable from the hot-air apparatus.

22. The hot-air brush of claim 15 further compising a tube with holes connected to the hot-air blower and positioned within the brush head.

* * * * *